United States Patent [19]

Noyes et al.

[11] 4,308,669

[45] Jan. 5, 1982

[54] ADVANCED OPTIMUM CONTINUOUS CROSSFLOW GRAIN DRYING AND CONDITIONING METHOD

[75] Inventors: Ronald T. Noyes; Eugene E. Williams, both of Frankfort, Ind.

[73] Assignee: Beard Industries, Inc., Frankfort, Ind.

[21] Appl. No.: 151,288

[22] Filed: May 19, 1980

Related U.S. Application Data

[62] Division of Ser. No. 942,447, Sep. 14, 1978, Pat. No. 4,249,891.

[51] Int. Cl.[3] ..... F26B 3/14

[52] U.S. Cl. ..... 34/33; 34/65; 34/168; 34/174; 34/236; 432/14

[58] Field of Search ..... 34/33, 64, 65, 168, 34/174, 176, 236; 432/17, 97, 101

[56] References Cited

U.S. PATENT DOCUMENTS

| | | | |
|---|---|---|---|
| 2,548,262 | 4/1951 | Hintz | 34/171 |
| 2,654,590 | 10/1953 | Molenaar | 34/174 |
| 3,864,845 | 2/1975 | Cooper | 34/171 |
| 4,149,844 | 4/1979 | Noyes | 432/17 |

*Primary Examiner*—Larry I. Schwartz
*Attorney, Agent, or Firm*—Henderson & Sturm

[57] ABSTRACT

A continuous grain drying and conditioning apparatus of a type including a burner and blower, or a multiplicity of burners and blowers, surrounded by a plenum chamber, air pervious grain holding walls positioned outwardly with respect to the plenum chamber is characterized by having a plenum divider which is selectively adjustable in position to divide the grain holding walls into a heating section and a cooling section. A multiplicity of grain turning apparatus of full and partial width of the grain column is disposed in the grain column for separating the grain mass into two or more separate divisions and then turning the cooler-wetter grain inwardly as it moves downwardly and turning the hotter-dryer grain outwardly as it moves downwardly in the grain column. Grain is constantly removed from the bottom of the apparatus at a rate governed by the average temperature of the air exiting the grain at a point adjacent the position of the plenum divider and a point closer to the input of the grain. Grain to be dried and conditioned is constantly introduced into the top of the apparatus at a rate that satisfies the rate of discharge of the dried and conditioned grain as it is delivered out of the bottom of the apparatus. Structure and management is also provided for controlled recycling of unsaturated exhaust air back through the dryer, whereby, the exhaust air is selectively proportioned and controlled based on the degree of saturation of the lower portion of the exhaust air. Further control of the recycled air is obtained at the level adjacent to the closed plenum divider level by a door positioned in the weathershield which design causes a separation between upper heated exhaust air which is diverted into the corner column for return to the blower, and the lower cooling air which is drawn by vacuum through the grain column cooling the grain. A still further consideration in this air control door is that the sloped separator panel is controlled by gravity, spring, or other closing means such that when grain particles or other foreign material builds up on the upper surface to a weight greater than the force holding the door closed, the door automatically begins to open, giving visual indication of needed cleanout, of vital importance in column grain dryers for optimum timing of housekeeping to maintain clean grain panel exhaust area and prevent fire hazards. A further modification of this air control door provides a means of using the entire grain column for drying when cooling of the grain is not desired by closing all cool air inlet louvers and positioning the air control doors at a position intermediate between fully closed as discussed above and fully open as for cleanout or supplemental cooling air inlet.

2 Claims, 16 Drawing Figures

Match Line Fig. 9B

ADVANCED OPTIMUM CONTINUOUS CROSSFLOW GRAIN DRYING AND CONDITIONING METHOD

This is a division, of application Ser. No. 942,447 filed on Sept. 14, 1978 now U.S. Pat. No. 4,249,891.

BACKGROUND OF THE INVENTION

The present invention relates generally to grain drying equipment and more particularly to an improved continuous crossflow column grain dryer with optimum drying air recirculation and simultaneous improved specific grain mass position rotation within the grain column.

It is generally believed that continuous crossflow dryers, that is, those dryers which have wet grain continually entering the dryer and dried grain continually exiting the dryer with drying air passing across the flowing column of grain, were not suitable for drying grains having a high moisture content. The reason for the difficulties experienced in the use of conventional continuous crossflow dryers was that they only operated at their optimum design performance over a fairly narrow band of moisture removal range due to fixed design conditions such as a fixed cooling air flow, a fixed cooling plenum exhaust area, a fixed heated air flow, a fixed heat plenum exhaust area, and homogeneous grain flow with constant exposure of one face of the grain mass to the heat plenum wall, causing heat damage.

At a grain moisture removal of 6 to 8 percentage points, most conventional dryers work satisfactorily. The cooling rate is matched fairly well with the drying rate. The grain column is usually split 25–35 percent cooling and 65–75 percent heating. The total blower horsepower is normally split to be 30–40 percent cooling and 60–70 percent drying. Dryers with a 25 percent cooling column usually use the upper extreme in cooling horsepower, thus operating the cooling plenum at a higher static pressure than the heating plenum and delivering 50–100 percent more cool air per bushel than drying air.

Under conditions wherein grain coming from the field is very high in moisture, and the drying rate is slowed significantly, the grain in such prior art systems was over cooled, which is not a particular problem from the standpoint of the quality of the grain dried, but it does waste considerable energy. Under very dry grain inlet conditions wherein the moisture removal is in the 3–5 percentage range, cooling is inadequate and fuel cost per bushel is very high. If grain conditioned by such a process is to be stored in a non-areated storage and therefore has to be cooled considerably after being dried in the dryer, the only reasonable solution was believed to be to cut back on the drying temperature to drastically slow down the drying rate to the point at which the grain retention time in the cooling zone was adequate to cool the grain. It is well-known that the efficiency of the drying process is reduced when plenum temperature of a crossflow dryer is reduced. It is also well-known that the grain to be stored in non-areated storage cannot be too hot or it will deteriorate. There is, therefore, the need for a continuous flow drying apparatus which will overcome these problems found with prior art devices.

Another weakness with most conventional continuous crossflow column grain drying devices is that when drying grains under conditions where cooling the grain in the dryer is not desired, the cooling air flow must be blocked off and the cooling grain column is of little or no value in drying. There is, therefore, a need for equipment of this type which will adequately compensate for this situation by having a design that can be easily adjusted to provide drying of grain in the grain column area normally used for cooling to maximize the performance of the dryer.

It is also known that conventional continuous flow column grain drying devices are limited in their maximum plenum temperatures and therefore in their drying efficiency because of the kernel temperature limits of the layer of grain that is continuously exposed to the hot plenum air as the grain moves downward sliding against the inner perforated grain column wall that forms the plenum chamber walls. There is, therefore, a need for equipment of this type which will overcome this kernel temperature limitation and improve drying efficiency by proving a design that limits the amount of travel that a given layer of grain can move in direct contact with the heat plenum wall before it is positively displaced by a cooler, wetter layer of grain, with this process alternating between (but not limited to any given sequence of full and partial column width changes) partial thickness changes and full thickness changes so that a given grain kernel would have little or no opportunity of repeating its contact with the hot plenum wall.

SUMMARY OF THE INVENTION

The present invention relates to a grain drying and conditioning apparatus having a housing with an outer impervious skin with air inlet, grain inlet, grain outlet and air exhaust structures connected thereto. Spaced air pervious walls are disposed within the housing and skin for confining a column of grain to be dried and for forming a column of air between the outermost impervious skin and the outermost pervious grain confining wall. A blower and burner mechanism is also connected to the housing for causing heated air to be forced through a first zone of the column of grain in one direction to heat and extract moisture therefrom and simultaneously causing air for cooling the grain to be pulled through the air inlet structure and through a second zone of the grain column in an opposite direction to the flow of the heated air. A plenum chamber is formed between the innermost of the pervious walls and the blower and the air duct structure and an adjustable plenum divider mechanism is provided between the innermost of the walls and the blower and air duct structure in the plenum chamber for selectively adjusting the relative extent of the zones and for dividing the plenum chamber into a first and a second section for the purpose of optimizing the heating and cooling of the grain in the first and second zones.

Air recycling structure and specific air control devices for regulating the volume of exhaust air versus recycled air in the exhaust area of the dryer is provided for blending unsaturated exhaust heated air which was forced through the upper grain column area by pressure with incoming cooling air drawn through the lower grain column area by suction to save the energy in such heated air. A multiplicity of grain turning apparatus are used in combination with the structures mentioned above in this section wherein a partial width grain turning device for diverting the innermost and warmest grain to the center and the center wetter cooler grain to the inside as the grain passes through the first drying section of the grain dryer, and a full width grain turning device for diverting the outermost and wetter grain to the inside and the inner hotter drier grain to the outside as the grain passes through the second drying section of the grain dryer, with repeated levels of partial and full turns, but not limited to that specific alternating pattern, to thereby facilitate even drying the grain in such grain column, and improving drying efficiency significantly by not overdrying to reach a desired "average" final moisture level.

An improved air control door that contains an air separation device is also provided that separates the cooling air entering below the separation device and flowing into the space between the outer weathershield and the outer pervious wall then drawn through the grain column in the cooling zone, from the exhaust heated air as it flows from the drying column then laterally along the top face of the air separation device and enters the openings in the corner columns for recycling to the blower and burner. This air control door provides additional novel and unique functions that provide valuable management capability to the dryer. First, the counter weight gravity, or spring held, combination design, or other means, provides an indication of buildup of grain particles, grain chaff or hull sections and other foreign material by gradually opening under the weight force, giving a visual indication of the need for cleaning. Variations in wind pressure or wind gusts which vibrate the doors, which may be latched or secured during the period when no drying is being done, but is not necessarily latched while drying, will cause movement of the door air divider plate, causing the fines to drop through the gap space caused by the buildup of foreign material until the weight of the particles reduces to the level where the wind forces do not cause significant movement of fines through the gap. This function of visable indication promotes better management control of material that sifts from all continuous flow column type dryers by improving housekeeping, keeping the outer pervious wall areas from being gradually covered which will reduce effective drying area while also minimizing potential safety hazards due to fire. Second, the device can be positioned by cable control or other means to an intermediate position whereby the inclined air divider plate rotates to a position where it is vertically in line with the other weathershield or louver flanges blocking air escape or entry. This novel feature in conjunction with closed cooling louvers allows the dryer to be operated on heated air drying over the entire column, thus providing optimum operation and maximum capacity when drying conditions do not require cooling. Further the doors can be opened fully to provide additional cooling air entry points, reducing the suction load of the fan thus providing an increased and more evenly distributed cooling airflow, and more efficient blower motor and fan operation.

An object of the present invention is to provide an improved grain drying apparatus.

Another object of the invention is to improve the control and use of the cooling zone of the dryer by being able to easily and readily adapt the area of grain column normally used for cooling to additional drying area thus increasing the drying capacity and efficiency of the drying apparatus by using the entire grain column for heated air drying.

Still another object of the invention is to provide an apparatus for controlling the amount of exhaust air released to atmosphere based on the humidity of the portion of the exhaust air coming from the lower exhaust opening so that the dryer efficiency is further improved.

A still further object of the invention is to provide a multiplicity of grain turning devices which are positioned in the grain drying columns for strategically transferring the warmest grain away from the inside of the column while moving cooler, wetter grain from the central or outer portions of the column to the inside in specific sequences, based on the type and condition of each grain, for reducing heating and cooling stresses and reducing the moisture difference between kernels of grain being dried.

Another object of the invention is to control both the upper and lower limits or levels and thus the volume of the drier exhaust heated air containing economically usable drying energy and return it to the blower for blending with cooling air and free ambient air to reduce the fuel consumption of the device while drying grain thus providing a dryer of significantly higher efficiency and operating economy than prior art drying systems.

Other objects, advantages and novel features of the present invention will become apparent from the following detailed description of the invention when considered in conjunction with the accompanying drawings.

BRIEF DESCRIPTION OF THE DRAWINGS

FIGS. 4 and 4A are partial enlarged cut away side elevational views of the present invention showing the relationship between the plenum dividers between the heating and cooling plenums, and the actuating mechanisms for the weathershield plenum blocking air control doors in the air column between the grain column and the outside impervious skin of the dryer, as used for normal drying with cooling of grain; FIG. 4A shows the portion of the dryer immediately above that shown in 4B so that for the easiest understanding of FIGS. 4A and 4B, the drawing of 4A should be placed above 4B for viewing;

FIGS. 5A and 5B are views showing the same mechanism relationships as FIGS. 4A and 4B, but arranged for drying without grain cooling such that all of the grain column is used for drying; FIG. 5A shows the portion of the dryer immediately above that shown in 5B so that for the easiest understanding of FIGS. 5A and 5B, the drawing of 5A should be placed above 5B for viewing;

FIG. 9A shows a top portion of the dryer, FIG. 9B the portion of the dryer immediately below that shown in FIG. 9A and FIG. 9C shows a portion of the dryer immediately below 9B so that for an easier understanding of FIGS. 9A, 9B and 9C; FIG. 9A should be on top, FIG. 9C below and FIG. 9B interposed between FIGS. 9A and 9C;

DESCRIPTION OF THE PREFERRED EMBODIMENT

Figure 1:
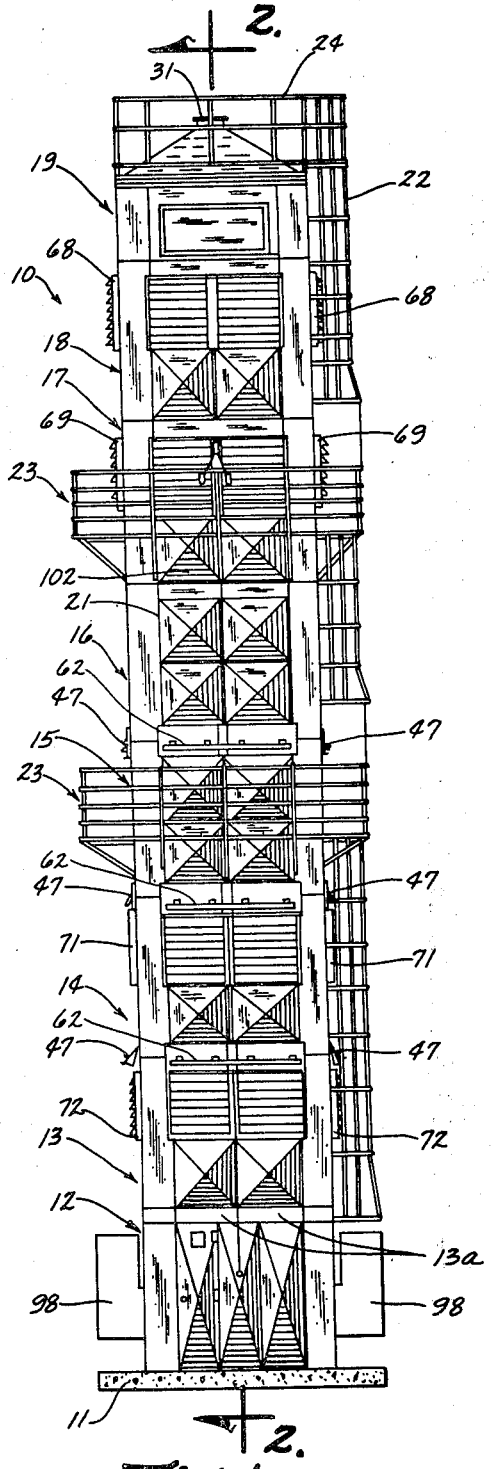
FIG. 1 is a side elevational view of the drying apparatus of the present invention.

Referring now to the drawings wherein like reference numerals designate identical or corresponding parts throughout the several views, FIG. 1 shows a preferred embodiment 10 attached at the bottom thereof to concrete base 11. The grain drying and conditioning apparatus shown in FIG. 1 has eight sections including a base section 12, intermediate sections 13–18 and a top section 19.

The framework of the invention has an outer skin 21 attached thereto on sections 13–19. Also connected to the framework is a ladder 22 including a safety cage. Service platforms 23 are also connected to the framework. A railing 24 on top of the grain drying and conditioning apparatus 10 is provided for allowing safe access to this top portion of the device.

Figure 2:
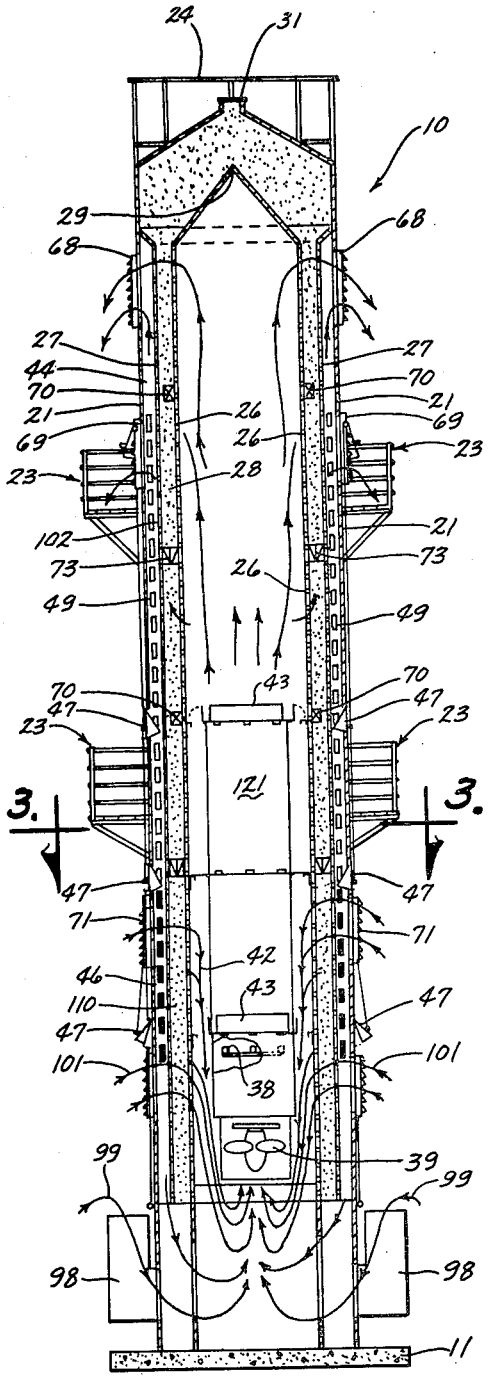
FIG. 2 is a cross-sectional view of the present invention taken along line 2—2 of FIG. 1 showing the drying and cooling mode of operation.
Figure 3:
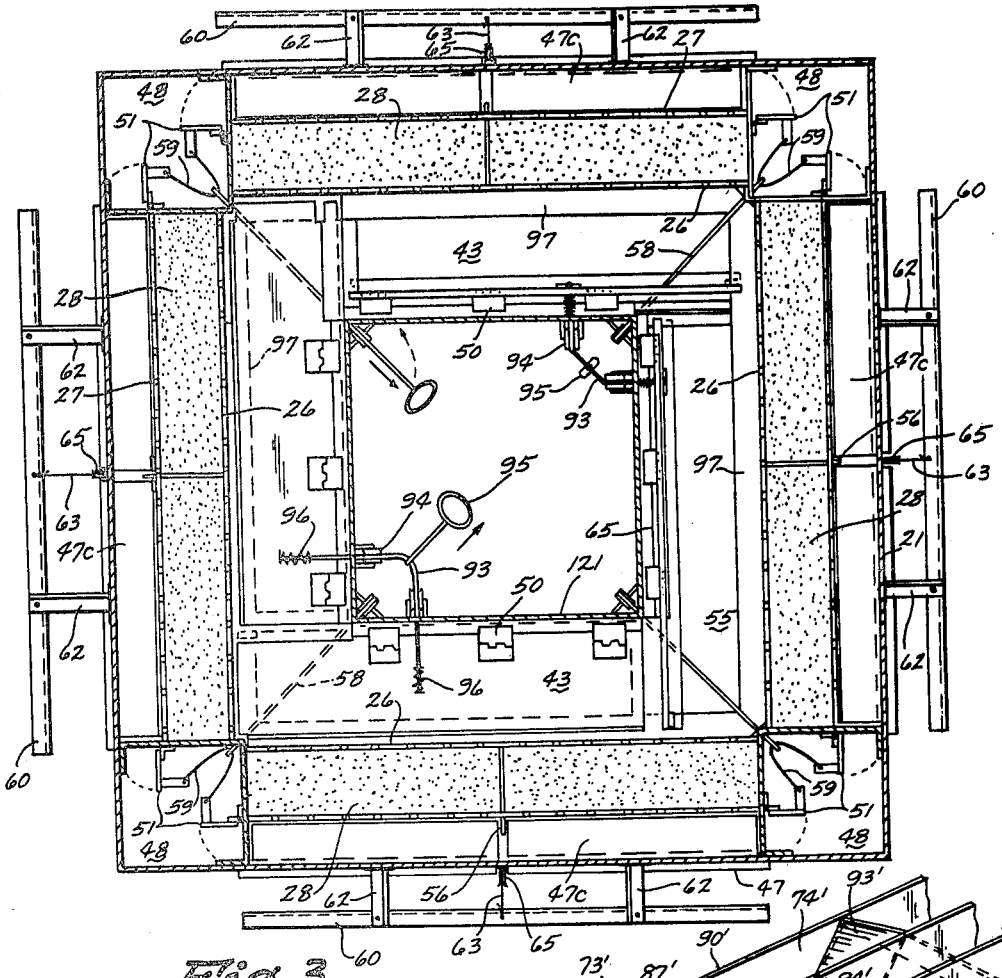
FIG. 3 is a cross-sectional view of the present invention taken along line 3—3 of FIG. 2.

Referring now more specifically to FIG. 2, it is noted that a pair of air pervious walls 26 and 27 are disposed on each side of the device for confining the grain 28 therein. The tops of the walls 26 converge together to a point 29 so as to funnel the grain downwardly into the grain column 28 containing the grain being dried. A grain inlet 31 is provided in the top section 19 for introducing grain to be dried and conditioned so that it can flow by gravity through the device 10. Grain metering rolls 32 (FIGS. 4, 4A, 4B, 5A and 5B) are provided at the bottom of each grain column 28 in the base section 12 for controlling the amount of grain which is allowed to flow out into grain collecting hopper 33 (FIG. 10) which lead to gravity flow grain chutes 34 (FIG. 10) to the discharge point 36, which can have an auxiliary unloading conveyor 37 attached thereto.

Figure 10:
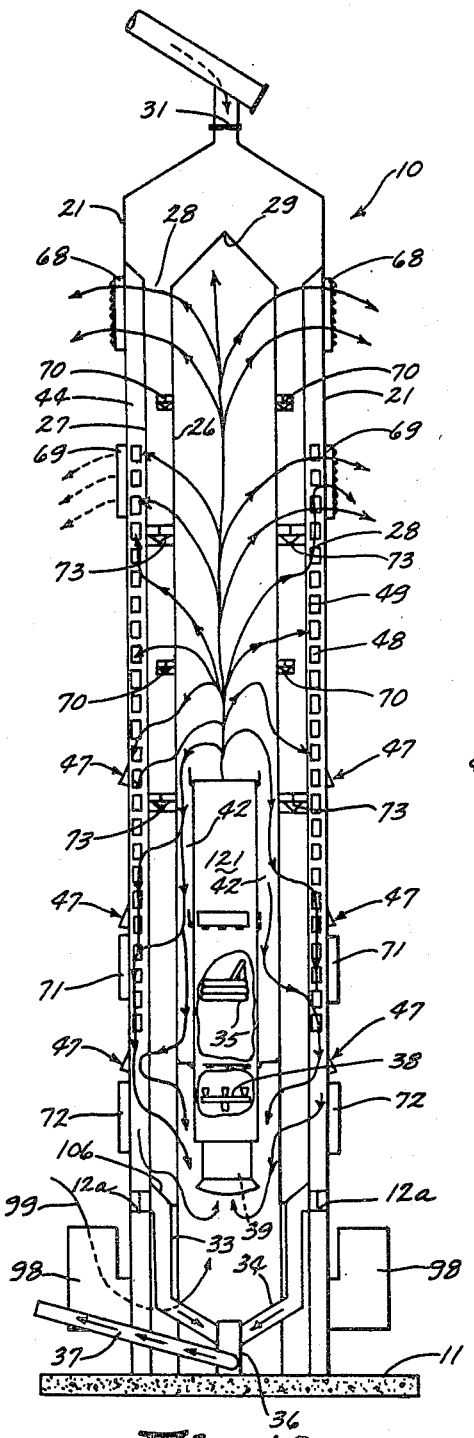
FIG. 10 is a cross-sectional view like FIG. 2, but showing the drying without cooling mode of operation including a different plenum level in use.
Figure 11:
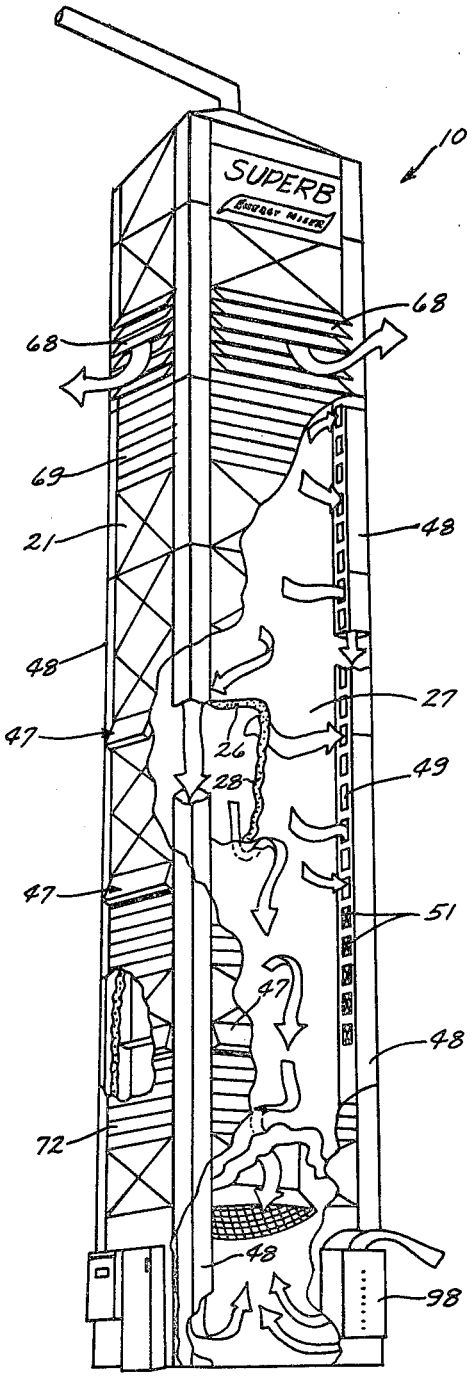
FIG. 11 is a partial cut away diagonal exterior full height view of the dryer structure showing air patterns that would be typical of operation of drying without cooling with maximum recirculation of heated air and free air control balancing exhaust air from the top louver.

A burner 38 for heating blower air flow is best shown in FIGS. 2 and 10 and is mounted downstream from a blower fan 39 used for forcing air upwardly through the burner 38. A plenum chamber is thereby formed between the air duct 121 and the inner pervious grain holding wall 26 and above the air duct 121 between grain holding walls 26; this plenum chamber is divided into an upper plenum chamber 41 and a lower plenum chamber section 42 by means of an adjustable plenum divider structure including doors 43 which are pivotally mounted to the air duct walls 121. One level of the plenum divider is always closed and the other plenum divider doors are always open.

Still referring to FIG. 2, it is noted that an air column is formed between the outer skin 21 and the outermost pervious wall 27. This air column is also divided into a first section 44 and a second section 46. The dividing line between the air column sections 44 and 46 is whichever of the weathershield plenum air control doors 47 which are closed. In normal drying practice, the weathershield plenum air control door 47 is closed at the same chosen level as the plenum divider doors 43 which are closed and this forms the dividing line. Weathershield plenum air control doors 47 above the closed plenum divider level may be at the fully closed or intermediate position, but weathershield plenum air control doors below the selected plenum divider level must be operated in the intermediate or open position.

Figure 6:
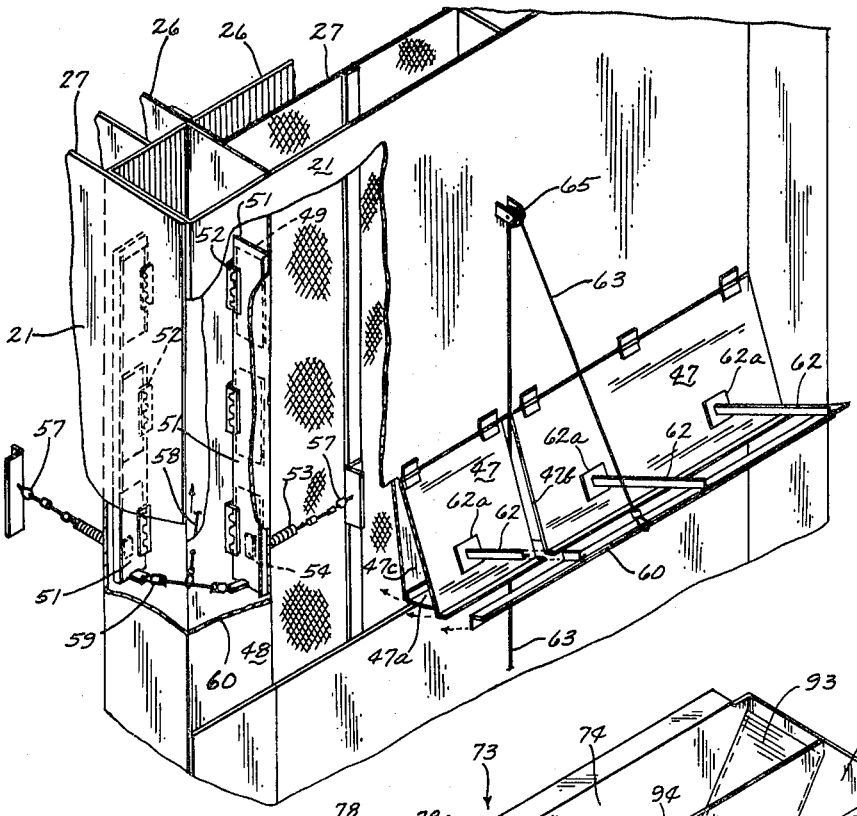
FIG. 6 is a perspective view of a corner section of the present invention with a portion thereof broken away to show horizontal weathershield plenum blocking air control doors relating to vertical air control doors leading to corner sections of the structure which serve as air return ducts.

Referring to FIGS. 6 and 2, for example, it is noted that on each corner of the device there is a corner column structure 48 and that this corner column structure 48 has a plurality of openings 49 therein.

These openings 49 are selectively opened or closed by means of doors 51 which are hingedly attached to the inside of the corner column by hinges 52 and are biased to a closed position by means of a tension spring 53 which is in turn, attached at one end thereof to the door 51 by a bracket 54 and at the other end to a structural frame member 56, within the air column comprised of sections 44 and 46. These doors 51 are normally held closed to the position shown in FIG. 6 and they can be opened by pulling on the cable 58 which pivots the doors open for air flow entrance into the corner column 48 through openings 49. The cable 58 which leads into the air duct 121 of the grain drying apparatus 10 is then secured in order to hold these doors in an open position, overcoming the bias of the springs 53. Once the cable 58 is released, the doors 51 will, of course, return to the closed position.

Also shown in FIGS. 4A, 4B, 5A, 5B and 6 is the mechanism for opening or closing the weathershield plenum air control doors 47 at a particular desired level. A counterbalance beam 60 such as a structural angle or other gravity force means is rigidly attached to a lever arm 62 which is rigidly attached to the face of the door 47 by means of a bearing plate 62*a* on the end of lever arm 62 so that pulling downwardly on the (bottom portion of) cable 63 routed over pulley 65 and attached to the weight beam 60 causes the door 47 to be open, and releasing tension on the cable 63 attached to the weight beam 60 causes the door 47 to be closed. By pulling the door 47 open to a pre-selected intermediate position, the inclined air sealing or blocking plate 47*a* stops its rotation in a plane vertically in line with the outer impervious weathershield wall 21, making a continuous sealed air passageway. The other doors 47 at the same level and at other levels can be operated in a similar fashion.

Figures 4A, 5A:
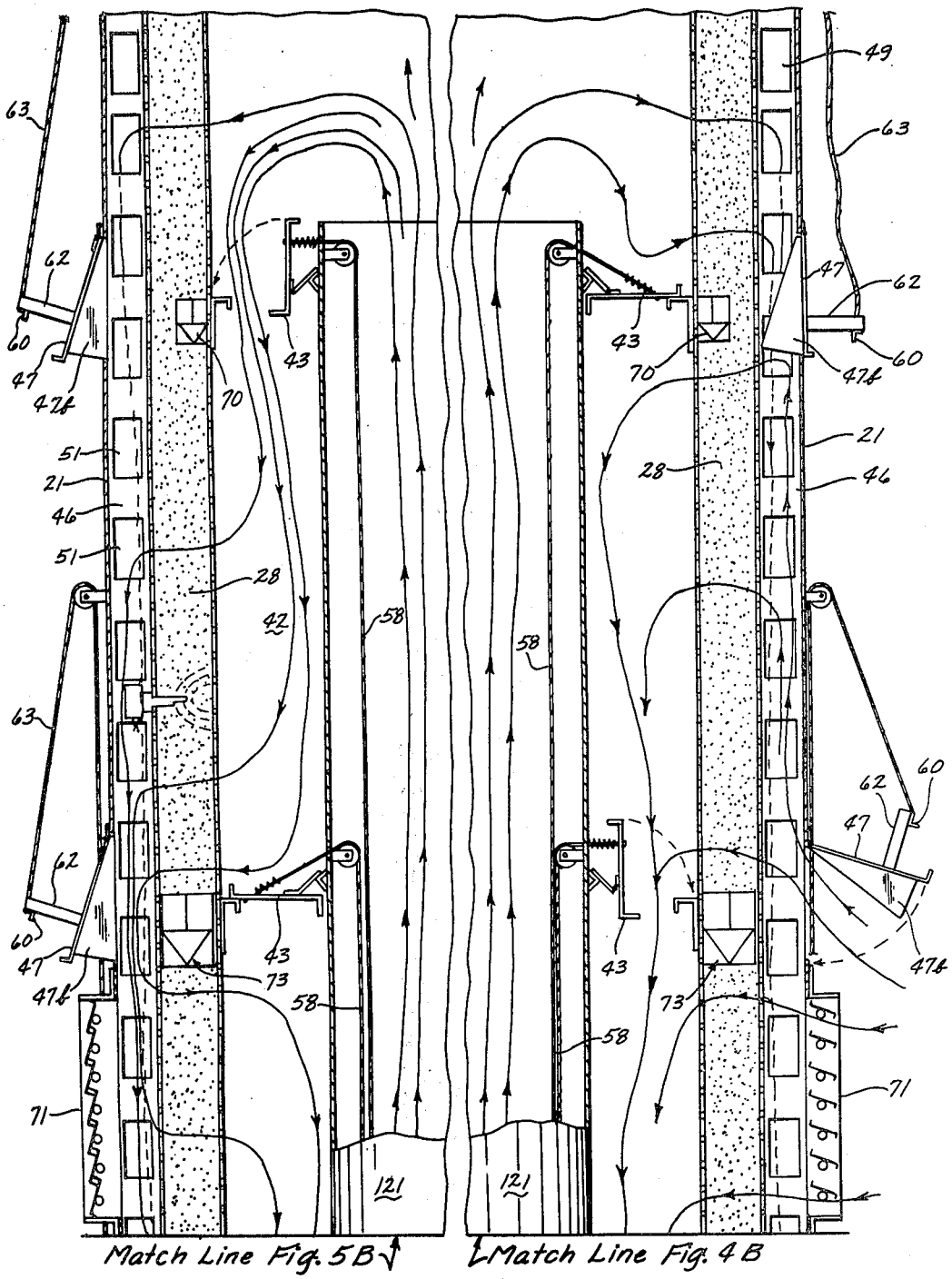
Figures 4B, 5B:
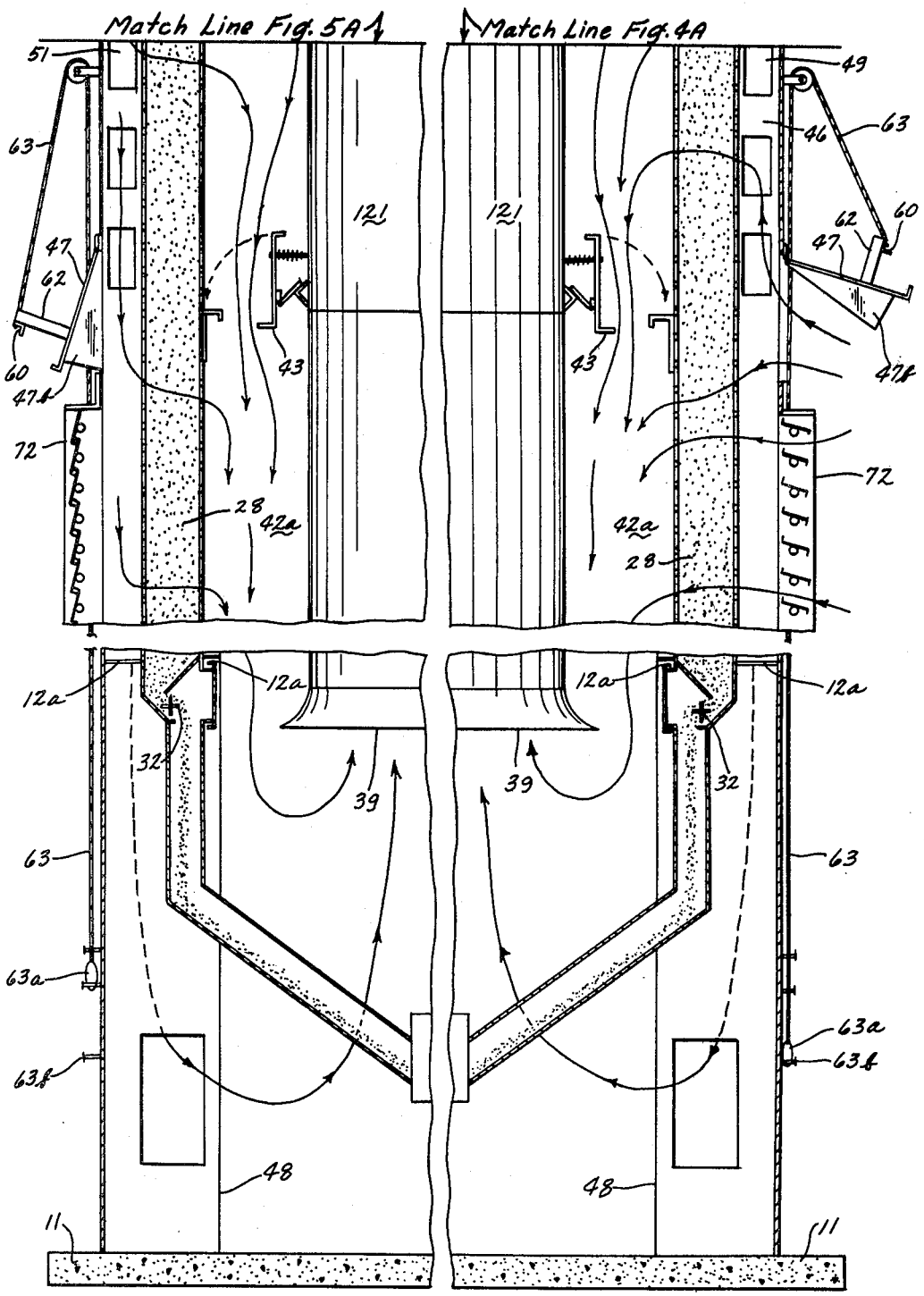

FIGS. 5A and 5B show partial sectional views of the blower 39, air duct 121, grain column 28, weather shield 21, air column 46, and structural corner column 48 with plenum divider doors 43 and weathershield air control doors 47 positioned for normal drying with cooling. When a sufficient downward force is applied to cable 63, to overcome the gravitational force of beam 60 acting on lever arm 62, cable 63 moves over pulley 65 causing the weathershield door 47 to rotate about the hinge point connection to the weathershield panel 21.

When the correct intermediate or partial open position is reached, cable 63 is attached to a bracket means 63*b* suitable for securing the cable ring 63*a* and cable 63 for holding door 47 in that intermediate position, aligning the inclined door air sealing plate 47 vertically with the weathershield panels 21.

It can also be seen in FIGS. 4A and 4B that by continued pulling force on cable 63, weathershield door 47 will rotate beyond the intermediate position described previously in FIGS. 5A and 5B to a full open position useful for providing additional cooling air entrance reducing the fan suction pressure required to overcome the friction loss of air passing a considerable distance between inpervious weathershield panel 21 and pervious outer grain column panel 27 through air column 46 before passing through grain column 28 then to fan 39, as seen best in FIGS. 4A and 4B, for normal drying and cooling. This is especially important when drying a low moisture removal product with the uppermost plenum divider level 43 selected.

An equally important function is provided with the weathershield doors 47 in the relaxed or closed position as best seen in the upper weathershield door position in FIGS. 2, 4A and 4B when dust, dirt, grain kernel tips, broken particles, husks, hulls, and other foreign material small enough to pass through the pervious outer grain column panel 27 fall downward in the upper air column 44 and the lower air column 46 settling on the inclined air sealing panel 47*c* of weathershield door 47. As the mass of foreign material and grain particles accumulates on the inclined panel 47*c* in air column 46 between the impervious wall panel 21 and the pervious outer grain column panel 27 (for example at space X as shown in FIG. 4A), the accumulated weight gradually overcomes the resisting moment effect of counterbalance beam 60 and the doors 47 begin to open, giving visual indication of the need for immediate cleaning of the door panels. If the doors 47 were not cleaned immediately, the doors 47 will provide a self cleaning function, if the weight of counterbalance beam 60 is properly designed and if the hinges of door 47 are of the non-rust self lubricating type or the hinges are properly lubricated, by continuing to open allowing sifting of foreign material through the slot opening formed between the door air sealing panel 47*c* and the pervious outer grain column panel 27. Wind gusts against the door 47 and weathershield panel 21 will also generate random vibrations that will cause fluctuations in the door 47 position, agitating the accumulated foreign material and causing it to sift through the slot more rapidly.

To clean the foreign material from the inclined air seal door panels 47, a rapid succession of pulling and relaxing actions on each cable 63 is required, where the door is allowed to rotate downward upon release of the cable 63 tension, striking the impervious wall panel 21, dislodging the material, allowing it to fall down through the lower air column 46 past the lower weathershield door latched in the intermediate position, FIGS. 5A, 5B and 2, and past closed cooling louvers until the material reaches the top 12*a* of the base structure 12 where it accumulates and can be cleaned out from ground level through cleanout doors 13*a* (FIG. 1).

FIGS. 2, 5A, 5B, 10 and 11 illustrate a very important advantage of this preferred design wherein the entire height of the grain drying and cooling column can be utilized for drying when no cooling is desired, such as in drying rice, thus providing a method of using the structure to produce a higher rate of drying and at the same time operate at a higher level of economic and mechanical efficiency compared to conventional crossflow dryers which have no means of providing heat to the grain column zone normally used for cooling, and thus must operate without that portion of the dryer column, normally 25–35% of the total column, thereby not being of valuable use.

Referring to FIGS. 5A, 5B and 10, to operate the entire column in a drying mode, cooling louvers 71 and 72 are closed, the plenum divider 43 at the lowest or the intermediate level is closed, and all weathershield air control doors 47 are positioned at the intermediate position, as best seen in FIGS. 5A and 5B so that a continuous air column 46 opening is provided between the impervious outer wall panel 21 and the pervious outer grain panel 27. As hot exhaust air in the heat plenum 42 reaches the closed plenum divider 43, it turns and is forced by plenum static pressure to pass outwardly through the pervious inner grain column wall panel 26, the grain column mass 28, and outer pervious grain column panel 27, corner column air control doors 41 are closed for a specified distance above the plenum divider level, so air is forced by the remaining positive static pressure area in the air column 46 above the plenum divider level to the negative pressure area below the plenum divider level in the air column 46, thence back through the grain mass 28 by the vacuum from the suction plenum 42, created by fan 39. Thus, hot relatively dry exhaust air that has passed through the grain column from the lowest level of the pressure plenum is drawn back through the grain column, completing the drying with a tempered drying air quality. This method of drying has the further distinct advantage of reversing the drying front, which is an ideal condition from the standpoint that it minimizes kernel heat damage and narrows the moisture content spread across the grain column width, thus reducing overdrying and improving dryer efficiency.

Figure 8:
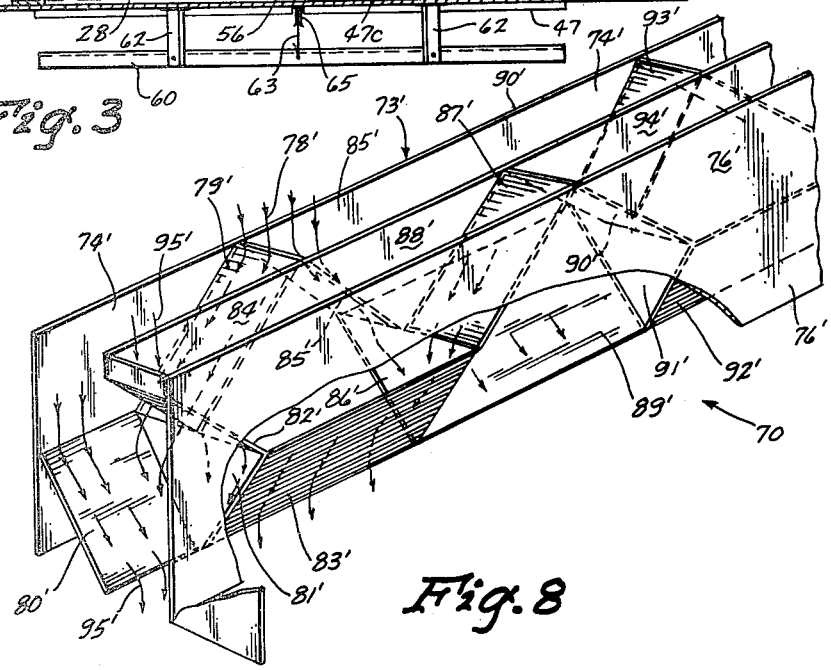
FIG. 8 is a detailed perspective view similar to FIG. 7 of a partial width grain turning apparatus shown schematically in FIG. 2.

Referring to FIGS. 7, 8, 9A, 9B and 9C, it is noted that a multiplicity of grain turning devices, full grain column width grain turn 73 and partial grain column width grain turn 70, are preferably disposed in each of the grain columns 28 between the walls 26 and 27, with alternating positions starting with the partial width grain turn 70 approximately 1/6 of the way (but not restricted to a specific spacing, number of positions, mixture of grain turns, or order of placement) down the drying column 28 from the garner bin 19; directly below the partial width grain turn 70, a full width grain turn 73 is placed, spaced approximately 1/6 of the column height from the previous partial width grain turn, followed alternately by a level of partial width grain turns 70, then full width grain turns 73, at equally spaced (but not limited to equally spaced) intervals. The purpose and substantial benefit of the partial width grain turn 70, shown in close detail in FIG. 8, is to cause grain flowing substantially near the innermost grain column wall 26, as position or zone "A" at the top of FIGS. 9A, 9B and 9C, to be displaced to a position near the center of the grain column while grain substantially near the center of the grain column, zone "B" in FIGS. 9A, 9B and 9C, to be moved to a zone substantially against the inner wall, 26, while a wider zone "C"–"D" between the center and outer wall is undisturbed and flows homogeneously without mixing downward past the partial grain turn 70. The full width grain turn 73, shown in close detail in FIG. 7, substantially splits the grain column in half for the purpose of causing the grain flowing downwardly which is near the outermost wall 27 to be diverted inwardly towards the innermost wall 26, and the grain which is near the innermost wall 26 above the grain turn 73 to be diverted outwardly towards the outermost wall 27 as the grain passes through the grain turning apparatus 73.

Figure 7:
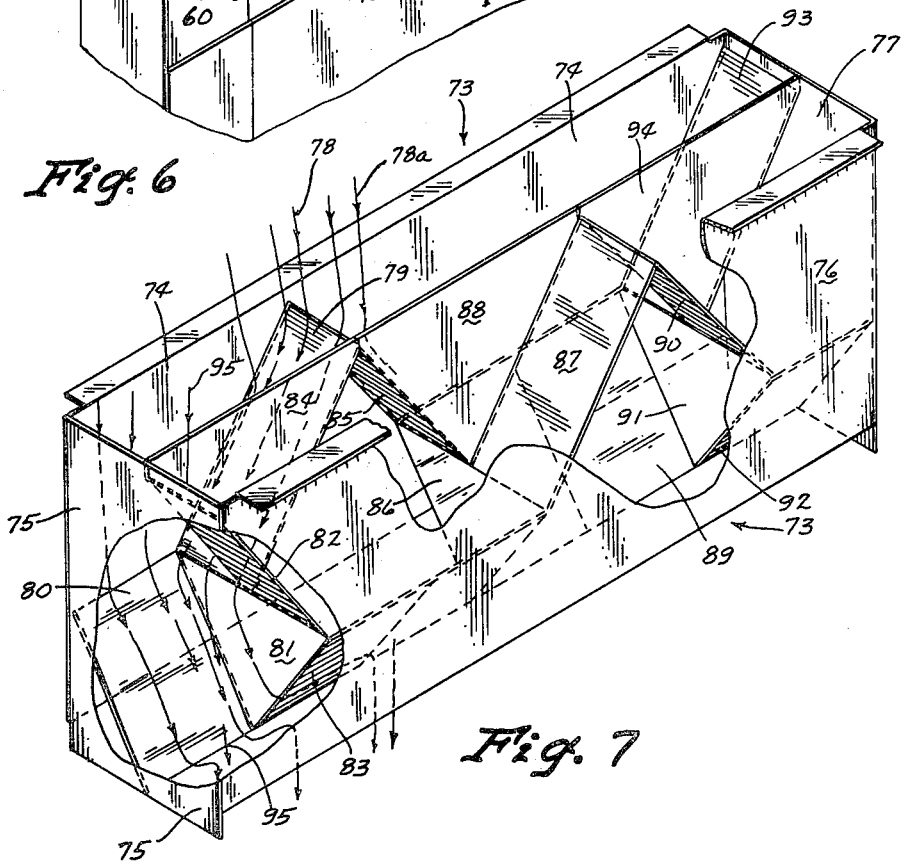
FIG. 7 shows a detailed perspective view of the full width grain turning apparatus shown schematically in FIG. 2.

Looking specifically to FIG. 7, it is noted that the device is constructed primarily of a plurality of outer flat walls 74, 75, 76 and 77. A single slanted wall 79 is attached at the top thereof to the slanted wall 85 and along one edge thereof to the wall 74. It is connected at the other side to a flat vertical triangular-shaped wall 84, which divides the grain into inner and outer separately moving masses, and at the lower end to triangular shaped wall 81. As the grain moves downwardly as shown by the arrow 78 in FIG. 7, it follows the top surface of the slanting wall 74, 75 and 81 turning 90 degrees in direction. This movement causes the grain to accelerate as it moves through the opening beneath slanted wall 82 and rotates through another 90 degree turn and spreads out against end wall 75 and under slanted wall 83, comingling with grain flowing in from slanted wall 85, which is welded to the top end of wall 79. Also, the grain from walls 85 and 93 flow into a column of grain flowing vertically downward beside wall 74 onto the center of slanted wall 89; each flow from walls 85 and 93 rotates 90 degrees onto the ends of sloped wall 89, then each flow rotates 90 degrees, again flowing under sloped walls 83 and 92 respectively. The grain flow from sloped wall 85 comingles with the grain flow from sloped wall 79 beneath sloped wall 83 and turns downward as seen by arrows 78 and 78*a*. The area between sloped wall 89 and sloped walls 87 and 90 forms a substantially larger opening than the space formed between sloped walls 80 and 82 and thus is capable of maintaining a similar velocity of grain as the adjacent grain turning section so that grain velocity into the top of grain turn 73 is substantially the same as the grain velocity leaving, although the grain accelerates and mixes in a desirable manner while passing through the grain turn. Diagonally opposite on the other side of the device 73, is a similar slanted wall structure 82 which is like a mirror image of the member 79 on the other side of turn 73, except that it forms half of a symetrically shaped hopper with wall 87 forming the other half; this member 82 is attached to the walls 75, 76, 81 and 84. Grain moving downwardly between the members 76 and 84 over and down the surface 82 would then generally follow the arrow 95 and the slanted wall 83 which is connected to the triangular plates 81 and 86. The sloped wall structure 89 between the triangular shaped walls 91 and 86 is substantially identical to the double width, sloped wall 83 apparatus just described on the left most side of the grain turning apparatus 73, as seen in FIG. 7. Once the separated grain masses, following individually arrows 78 and 95, have rotated 180 degrees and spread beneath walls 80 and 83, the two masses rejoin, continuing downwardly.

Figure 9A:
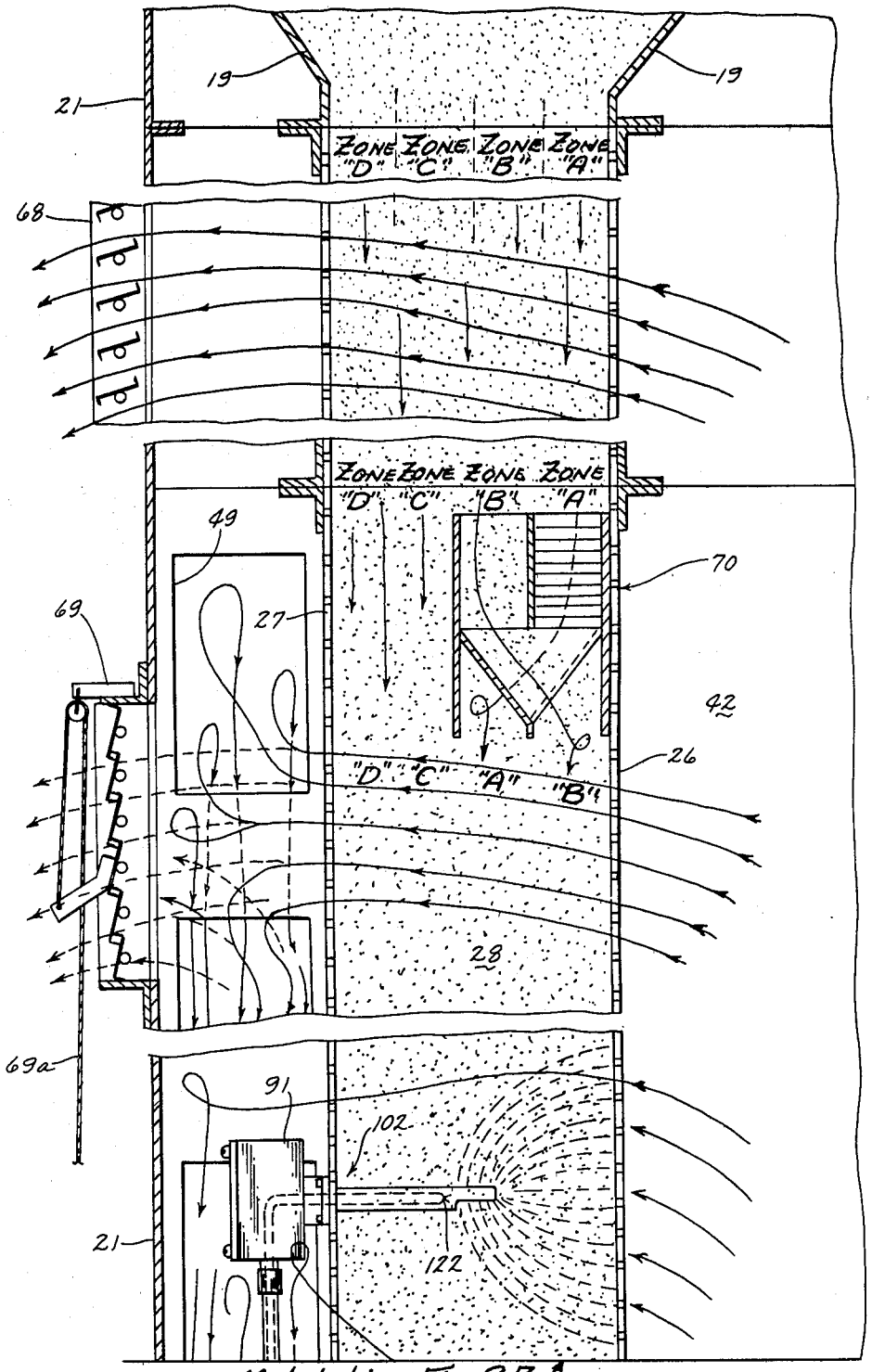
FIGS. 9A, 9B and 9C show enlarged, cross-sectional views of the detail of the sequence of the full width and partial width grain turning structures and their relative positions to the grain temperature sensing device used for "averaging", the lower humidity exhaust air control louver structure, hot plenum air and lower humidity exhaust air flow patterns, plenum divider and air duct relationship, and weathershield plenum blocking air control doors.
Figure 9B:
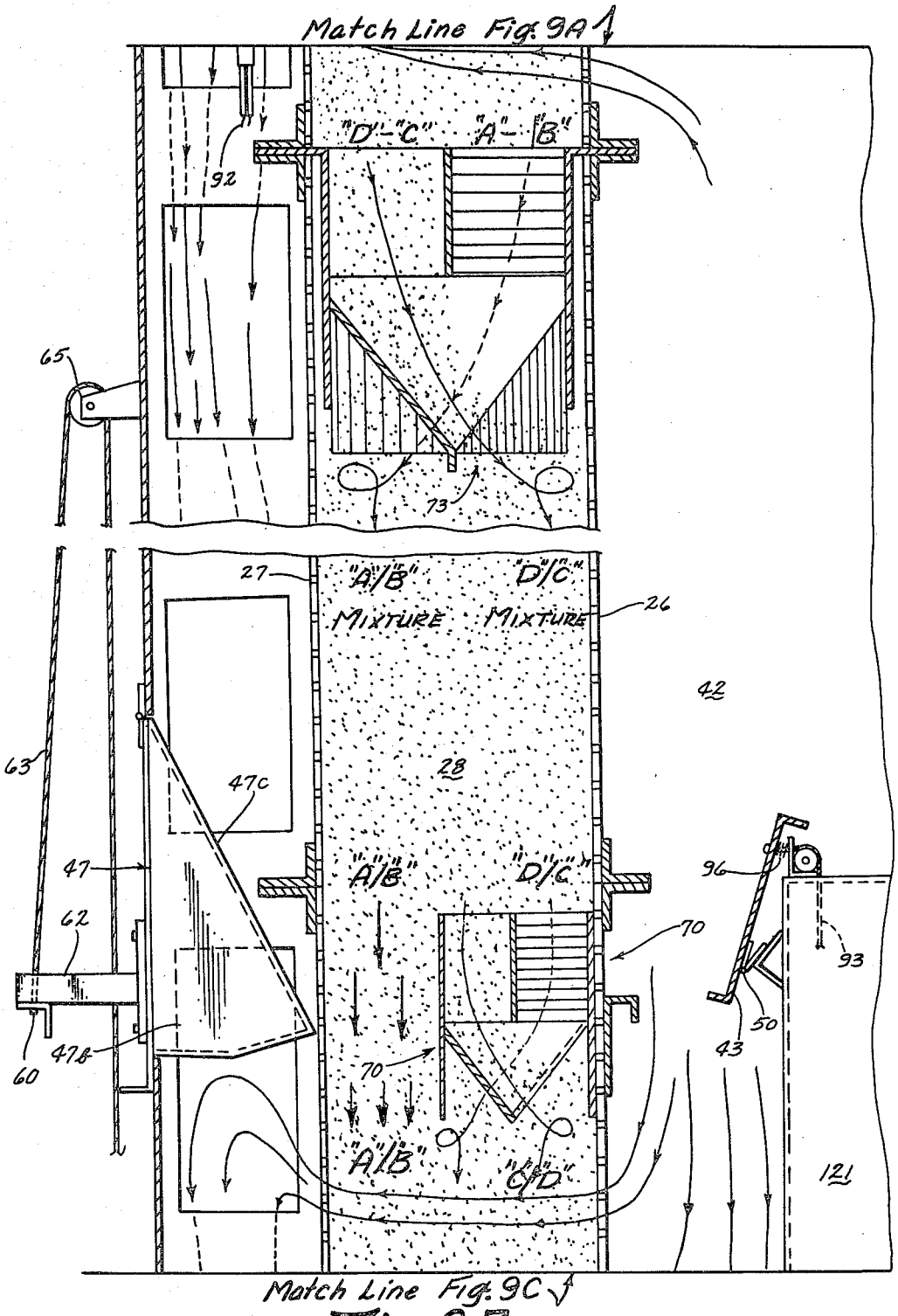
Figure 9C:
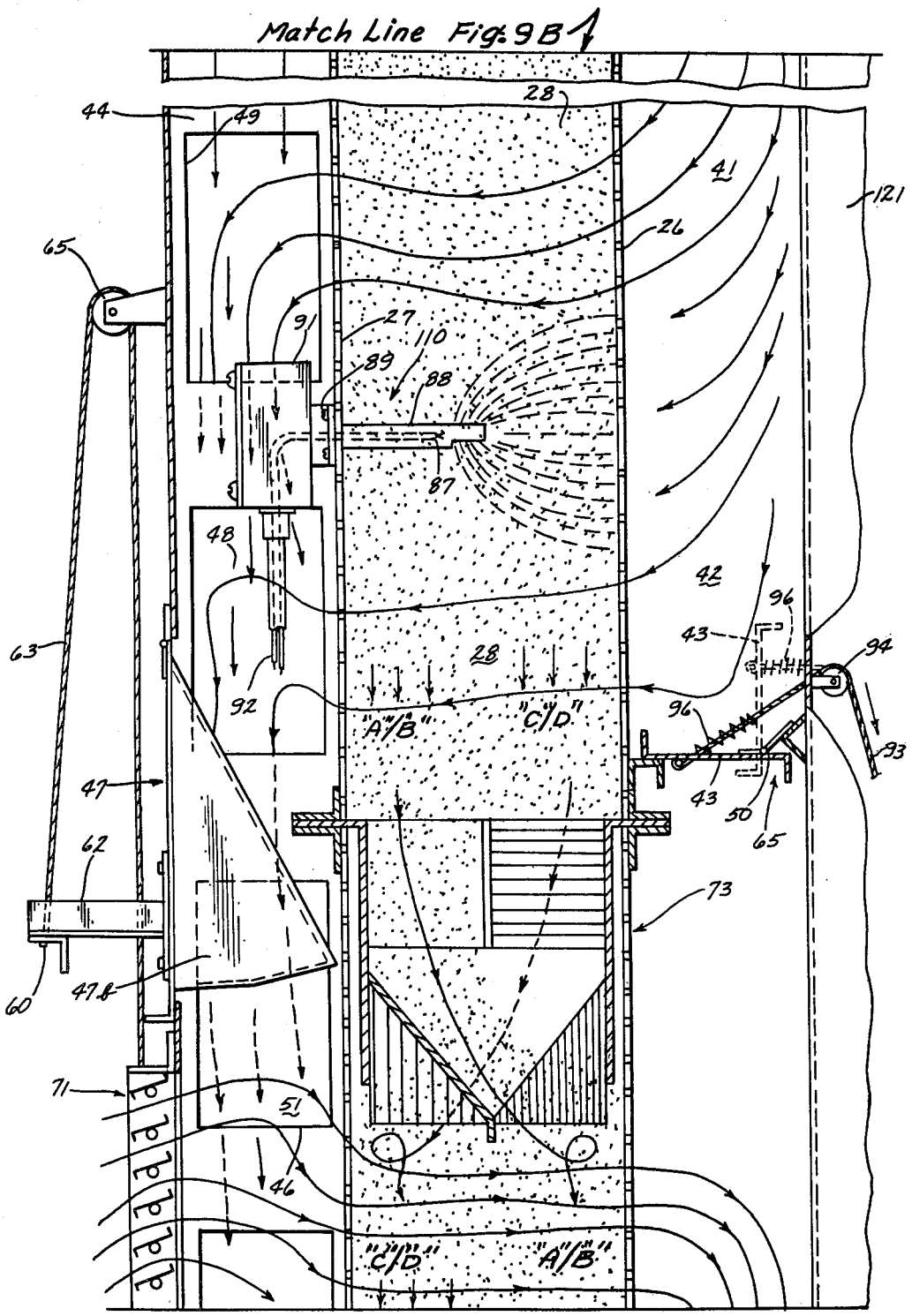

Turning now to FIG. 8, it is noted that a similar grain turning apparatus 70 with sloped walls of similar pattern but a narrower design and more numerous, smaller openings, and using non-flanged outer walls is designed to provide a substantially similar function of rotating the grain after dividing the grain mass that enters the top opening. Numbers with a prime attached thereto have been used to show the similarity of the structure shown in FIG. 7 and reference to the description of FIG. 7 will explain the operation of the FIG. 8 structure, noting the corresponding reference numerals. The significant and unique difference between the full width apparatus and the partial width apparatus is that the full width grain turn process all grain in the column, substantially mixing it, whereas the partial grain turning apparatus mounted as best shown in FIGS. 9A, 9B and 9C, selectively processes only a portion of the warmer grain in the center of the grain column 26 and hotter grain against the inner wall 26, zones "A" and "B", FIGS. 9A, 9B and 9C, allowing the grain mass, zones "C" and "D" from near the center of the grain column 28 to the outer wall 27 to flow past the partial grain turn in a substantially homogeneous and unmixed state. The extreme importance of the partial turn is that it moves the narrow layer of grain that is subjected to very high drying temperatures, zone "A", FIGS. 9A, 9B and 9C, away from the wall after a relatively short heat exposure time and isolates it near the center of the grain column 28, where it begins immediately tempering in a lower temperature yet still a very warm humid environment as the cooler wetter grain from the center zone "B" that was disposed against the inner wall 27 begins to release moisture and elevate in kernel temperature. When the grain flowing through and past the partial turn reaches the full width grain turn 73, the grain in zone "B", which has been moving along the inner wall with substantially the same heat time interval as zone "A" had previously been exposed to, plus the grain in zone "A" is substantially mixed as it rotates to the position in the outer half of the grain column 28 against the outer wall 26. Grain from zones "C" and "D" are mixed substantially into a resultant D/C mixture now occupying the inner half of grain column 28 against the inner wall 27. Following a similar process of exposure time and rotation through the second partial grain turn (FIGS. 9A, 9B and 9C), it is clearly seen that the entire grain mass is substantially segmented or isolated in such a manner that kernels from each of the zones "A", "B", "C", "D" can only be subjected to extreme air temperatures against the inner pervious plenum wall 27 once until the fifth drying zone is reached, and even at that point the percentage of kernels from zone "A" or zone "B" that would be subjected to drying in the first kernel layers again that had previously been in that layer would be extremely small. Even kernels that had previously resided against the inner wall in drying zone 1 would have had three complete lapse periods to temper, equalize moisture gradients and possibly absorb moisture from the nearly saturated air passing over the kernel surfaces in zones 3 and 4. It is well-known in drying design that kernels continuously subjected to intensive heat for long periods of time will sustain excessive heat damage and thus dryers without grain turning or mixing means must operate at lowered heat plenum temperature levels and thus at operating efficiency levels that are known to be less efficient, or damage grain when drying at higher temperatures, efficiencies and capacities.

The combined novel positioning of the full width grain turns in specific combination with the partial width grain turn at strategically designed vertical intervals provides a higher capacity, more efficient drying process than conventional crossflow dryers or crossflow dryers of the earlier design revealed in patent application Ser. No. 831,556 (incorporated herein by reference), due to the higher allowable plenum temperatures and the continuously controlled mixing which reduces the moisture spread and the extreme overdrying to reach an "average" blend. This grain turn apparatus design and method is not limited in numbers of parallel divisions or zones across the grain column such as zones "A", "B", "C", "D", but could be substantially more divisions on full width as when two partial turns are placed side by side to form a full width turn with four divisions, or substantially more divisions in a partial width grain turning apparatus.

As best shown in FIGS. 9A, 9B and 9C, the heated air which is going through the grain at the upper levels of the grain column 28, for example at the level of the louvers 68, is quite often completely saturated with moisture as it leaves the grain, but the air in the air column 44 at the lower exhaust louver 69 level is quite often warm but not completely saturated, varying based on the moisture content of the fresh grain entering the grain column 28 at the base of the garner bin 19. Consequently, it is often desirable to recirculate this warm and unsaturated air back to the blower 39 as a means of saving drying energy on a selective manual, semi-automatic or automatic basis. Thus, on very high moisture grain drying, the heated air exhaust louver 69 would be open as best shown in FIG. 9 by the dashed arrow lines leaving the louver, the exhaust under conditions of high moisture drying contains water vapor to the extent of saturation or near saturation conditions, totally unsuitable for recirculation because of the low level of usable sensible heat remaining in the air. However, in the illustration example shown best in FIGS. 9A, 9B and 9C by the solid airflow arrow lines in the air column 44 in close proximity to the closed louver 68, the air then moves by air pressure as it exits the grain column 28 and is then drawn by suction into and downward inside corner column 49 to the base. This condition when the louver 68 is closed would be with grain with low moisture removal requirements where the exhaust air contains a humidity level and sensible heat level that will result in a definite additional savings in fuel costs. Examples of use would be in soybean processing plants where soybeans of storage moisture content in the order of 13–15% moisture content (M.C.) wet basis is dried to approximately 10% M.C., the louver 69 would be operated continuously in a closed or recirculation mode, resulting in a recirculation of approximately 40 to 50% of the air that would normally be exhausted. A second grain crop that this novel control area will be of considerable economic value to is rice. It is a commonly known practice that only a portion of the total moisture to be removed from rice can be removed in a given lot or quantity of rice as it passes through the dryer each time due to a limitation in the maximum kernel temperature of approximately 105 degrees F.-110 degrees F. that rice kernels can tolerate; kernel temperatures above those levels cause excessive kernel stress cracks to form and breakage to occur, resulting in extreme economic value reduction. Rice therefore must be passed through the dryer quite rapidly, in the order of two to three times faster than other grains removing approximately 1 to 2 percentage points of moisture during each pass, then allowing the rice to temper or cool out slowly in a storage bin from 12 to 48 hours between passes; as many as 7 to 10 repeated passes through the dryer are made until a given lot of rice reaches a safe storage moisture level. The rice is usually harvested at a moisture content ranging from 18 to 25% M.C. wet basis, varying between varieties, with seasons, and with time of harvest in the season. By being able to selectively control louver 69 readily by manual control or other semi-automatic or automatic means from the base level, all exhaust air can be discharged during early passes, for example when the grain moisture is in the 17–25% range, but the louver 69 can be readily closed to recycle the lower level exhaust air when the air is of sufficient dryness and temperature, as when it exhausts from grain of less than 17 percent moisture content. Remote sensing means for monitoring temperature or relative humidity of the exhaust air provides a suitable indication of when the louver should be closed.

When the louver 69 is closed, reducing the amount of exhaust air leaving the dryer, continuously open exhaust louver 68, adjustment must be made to reduce the free air inlet control valves 98, located at the base of the dryer best shown in FIG. 10, so that free air 99 volume is reduced to balance out the cooling air volume 101 (FIG. 2) entering the dryer. To fine tune the balance of exhaust air versus incoming air so that total blower 39 airflow is not restricted, lower exhaust louver 69 can be operated and set at a partially closed position so that a portion of the lower exhaust air recirculates and a portion is exhausted in cases where total closure of exhaust louver 69 will cause a reduction of cooling air volume as indicated by a significant change in the positive and negative static pressure readings in the cooling plenum 42 and in the transition just downstream of the fan.

It is seen that by incorporating specific control of the exhaust air for each drying condition, cross flow drying economics can be further improved. Also, by using a plurality of partial and full width grain turns, grain quality can be improved and higher drying efficiencies can be obtained because of higher plenum temperature capabilities, and that by being able to selectively and easily control the weathershield air control valve doors so that the entire dryer can be used for drying with or without cooling, the dryer is more efficient for all types of grain crops and conditions as well as easier to keep clean and safer to operate. Thus these novel features further advance the level of technology for optimum crossflow drying.

Obviously many modifications and variations of the present invention are possible in light of the above teachings. Also, it is obvious that other particulate or granular materials, equivalent to grains in moisture content, particle size, and texture, could be dried and cooled, dried without cooling, or heated from a cool to a warm or hot stage for a specific process for which the material was intended. It is therefore to be understood that, within the scope of the appended claims, the invention may be practiced otherwise than as specifically described.

We claim:

1. A method of conditioning grain to minimize drying damage utilizing apparatus including:

first and second vertical spaced air pervious walls for confining a column of grain to be dried;

means for causing grain to pass down said grain column between said walls;

means for causing drying air to pass through and across said first wall, and said column of grain, and said second wall, respectively;

said grain column including first, second, third and fourth vertically oriented width segments along the length thereof, said first segment being adjacent to and in contact with said first wall, said fourth segment being adjacent to and in contact with said second wall, said second segment being disposed between said first and fourth segments and adjacent the first segment but spaced from the fourth segment, said third segment being disposed between and in contact with the second and fourth segments; said method comprising:

a step at a first level of said grain column wherein the grain in the first segment is transferred to the second segment and the grain in the second segment is transferred to the first segment, while at the same time the grain in the third and fourth segments are allowed to pass straight down undisturbed at that level; and a step at a second level of said grain column wherein the grain in said first and second segments are transferred to the third and fourth segments and the grain in the third and fourth segments are transferred to the first and second segments.

2. The method of claim 1 wherein one or more of said steps are repeated at different levels.

* * * * *